US008704714B2

(12) United States Patent
Ridgeway

(10) Patent No.: US 8,704,714 B2
(45) Date of Patent: Apr. 22, 2014

(54) SURFACE MOUNT MODULE EMBEDDED ANTENNA

(75) Inventor: Robert Wayne Ridgeway, Saratoga Springs, UT (US)

(73) Assignee: Digi International Inc., Minnetonka, MN (US)

( * ) Notice: Subject to any disclaimer, the term of this patent is extended or adjusted under 35 U.S.C. 154(b) by 452 days.

(21) Appl. No.: 13/151,739

(22) Filed: Jun. 2, 2011

(65) Prior Publication Data

US 2012/0306700 A1 Dec. 6, 2012

(51) Int. Cl.
*H01Q 5/00* (2006.01)
*H01Q 1/50* (2006.01)

(52) U.S. Cl.
USPC ..... 343/700 MS; 343/862

(58) Field of Classification Search
USPC ..... 343/700 MS, 702, 713, 807, 795
See application file for complete search history.

(56) References Cited

U.S. PATENT DOCUMENTS 6,731,513 B2 * 5/2004 Rodgers et al. ..... 361/777
2003/0179055 A1 * 9/2003 Sweeney et al. ..... 333/246
2007/0126121 A1 * 6/2007 Shue et al. ..... 257/774
2007/0182641 A1 * 8/2007 Luch ..... 343/700 MS
2011/0156981 A1 * 6/2011 Ridgeway ..... 343/862

OTHER PUBLICATIONS

"External Photos", Submitted to Federal Communications Commission—Office of Engineering and Technology, FCC ID: MCQ-XBS2C; URL: https://fjallfoss.fcc.gov/oetcf/eas/reports/ViewExhibitReport.cfm?mode=Exhibits&RequestTimeout=500&calledFromFrame=N&application_id=323860&fcc_id, (Jun. 24, 2010), 2 pgs.
"XBee / XBee-PRO ZB SMT RF Modules", ZigBee RF Modules by Digi International, Models: XBEE S2C, PRO S2C Digi International, Inc., (Aug. 19, 2010), 155 pgs.

* cited by examiner

*Primary Examiner* — Thien M Le
(74) *Attorney, Agent, or Firm* — Fogg & Powers LLC

(57) ABSTRACT

An apparatus includes a dielectric sheet, and an antenna structure. The antenna structure comprises a first conductive portion located on an exterior surface of the dielectric sheet and a second conductive portion buried in the dielectric sheet and configured for coupling to a return portion of the wireless communication circuit. The second conductive portion includes a plane area adjacent to the first conductive portion in a region proximal to the feed portion and separated from the first conductive portion by a portion of the dielectric sheet, a curved transition portion, the transition portion including a lateral width that tapers along the length of the second conductive portion, and a distal portion comprising two parallel conductive strips, the distal portion electrically coupled to the plane area via the curved transition portion, wherein the parallel conductive strips are thinner in lateral width than the plane area.

20 Claims, 6 Drawing Sheets

SURFACE MOUNT MODULE EMBEDDED ANTENNA

TECHNICAL FIELD

This document pertains generally, but not by way of limitation, to a surface mount assembly including an antenna.

BACKGROUND

Information can be wirelessly transferred using electromagnetic waves. Generally, such electromagnetic waves are either transmitted or received using a specified range of frequencies, such as established by a spectrum allocation authority for a location where a particular wireless device or assembly will be used or manufactured. Such wireless devices or assemblies generally include one or more antennas, and such antennas can be configured for transfer of information at a particular range of frequencies. Frequencies used for such communication can include frequencies used by various wireless digital data networking schemes. Wireless networking schemes can use, or incorporate aspects of one or more of the IEEE 802.11 family of "Wi-Fi" standards, one or more of the IEEE 802.16 family of "WiMax" standards, one or more of the IEEE 802.15 family of personal area network (PAN) standards, or one or more other protocols or standards, such as for providing cellular telephone or data services, fixed or mobile terrestrial radio, satellite communications, or for other applications. For example, in the United States, various ranges of frequencies are allocated for low-power industrial, scientific, or medical use (e.g., an "ISM" band allocation), such as including a first ISM band in the range of about 902 MHz to 928 MHz, or including a second ISM band in the range of about 2400 MHz to about 2483.5 MHz, or including a third ISM band in the range of about 5725 MHz to about 5825 MHz, among other ranges of frequencies.

Overview

In a system, a wireless communication circuit can be coupled to a separate antenna assembly, such as to provide reliable communications coverage within a building, around a site, or over a larger area, using a specified range of frequencies.

The present inventor has recognized, among other things, that integrating wireless communication circuitry or an antenna into an electronic system can pose various challenges. Use of a separate antenna assembly can be cumbersome, such as involving specialized radio-frequency (RF) connectors, cabling, or other techniques. Also, placing communication circuitry in proximity to other non-wireless circuitry can involve challenges such as grounding, shielding, or isolating the non-wireless circuitry and the communication circuitry from each other.

To reduce such design challenges, the present inventor has also recognized that a wireless communication circuit and an antenna can be integrated into a commonly-shared printed circuit board (PCB) assembly, such as including an antenna structure formed in one or more conductive layers comprising the PCB assembly. Incorporation of both the antenna and the wireless communication circuit into the same compact PCB can mitigate some of the design challenges associated with the layout and placement of wireless communication circuitry, or the challenges of designing or specifying an antenna for use with such circuitry. Such an assembly can include one or more surface mount interconnects, such as one or more pads, solder balls, metallic land regions, or other conductive portions configured to provide a solderable connection or other conductive bond to circuitry located on another printed circuit board assembly. In this manner, the PCB assembly including the circuitry and antenna can be easily incorporated into other designs in much the same way as other off-the-shelf components.

In an example, the present inventor has developed techniques to provide an embedded antenna structure including a usable bandwidth well in excess of the bandwidth generally needed for an IEEE 802.15.4 (2003) PHY layer (e.g., 16 channels times 5 MHz of bandwidth per channel, corresponding to 80 MHz of bandwidth, such as including a frequency range from about 2402.5 MHz to about 2477.5 MHz). Such excess bandwidth can provide an antenna structure that is more immune to variation in material parameters or the surrounding environment while still providing a specified input impedance within a specified range of operating frequencies, as compared to a narrow-band antenna.

According to various examples, an apparatus, system, or method can include a dielectric sheet and an antenna structure. The antenna structure includes a first conductive portion located on an exterior surface of the dielectric sheet and configured for coupling to an antenna feed for a wireless communication circuit, and a second conductive portion buried in the dielectric sheet and configured for coupling to a return portion of the wireless communication circuit. The second conductive portion includes a plane area adjacent to the first conductive portion in a region proximal to the feed portion and separated from the first conductive portion by a portion of the dielectric sheet, a curved transition portion, the transition portion including a lateral width that tapers along the length of the second conductive portion, a distal portion comprising two parallel conductive strips, the distal portion electrically coupled to the plane area via the curved transition portion, wherein the parallel conductive strips are thinner in lateral width than the plane area.

This overview is intended to provide an overview of subject matter of the present patent application. It is not intended to provide an exclusive or exhaustive explanation of the invention. The detailed description is included to provide further information about the present patent application.

Figure 1:
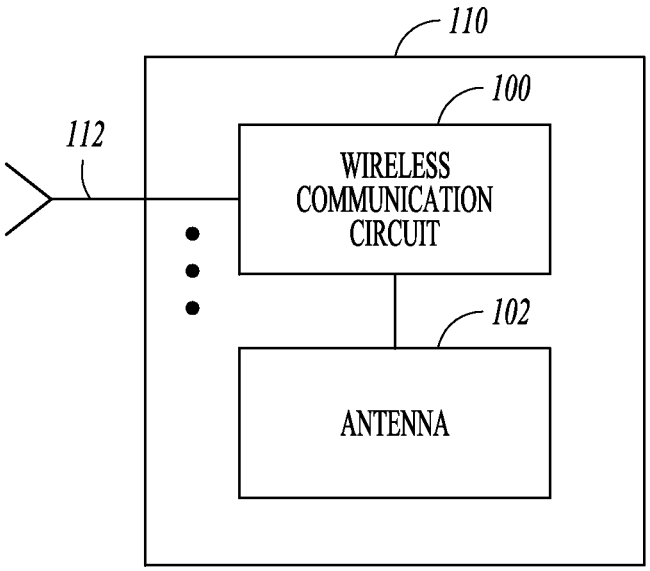
FIG. 1 illustrates generally an example of an apparatus that can include a wireless communication circuit coupled to an antenna, such as the antenna of FIG. 2-3, or 4A-B.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 illustrates generally an example of an apparatus 110 that can include a wireless communication circuit 100 coupled to an antenna 102, such as the antenna structure discussed in the examples of FIG. 2-3, or 4A-B. The apparatus 110 can include one or more electrical interconnects, such as an electrical interconnect 112 to carry signals from the apparatus 110 to another assembly. Such interconnects can be used for providing power, or for transferring control information or data to or from the apparatus 110 to another assembly. For example, the apparatus 110 can include a solder-mountable assembly, such as for surface mount attachment to a printed circuit board assembly. In an example, the antenna 102 can be embedded or otherwise formed in a printed circuit board comprising a portion of the apparatus 110. The wireless communication circuit can include circuitry to wirelessly transmit or receive information electromagnetically, such as for providing terrestrial radio communications between fixed or mobile stations. Such an apparatus 110 can be included as a portion of a larger system, such as soldered or attached to a printed circuit board assembly for use in a vehicular or aerospace application, or in an industrial or residential environment where wireless monitoring or control are desired.

Figure 2:
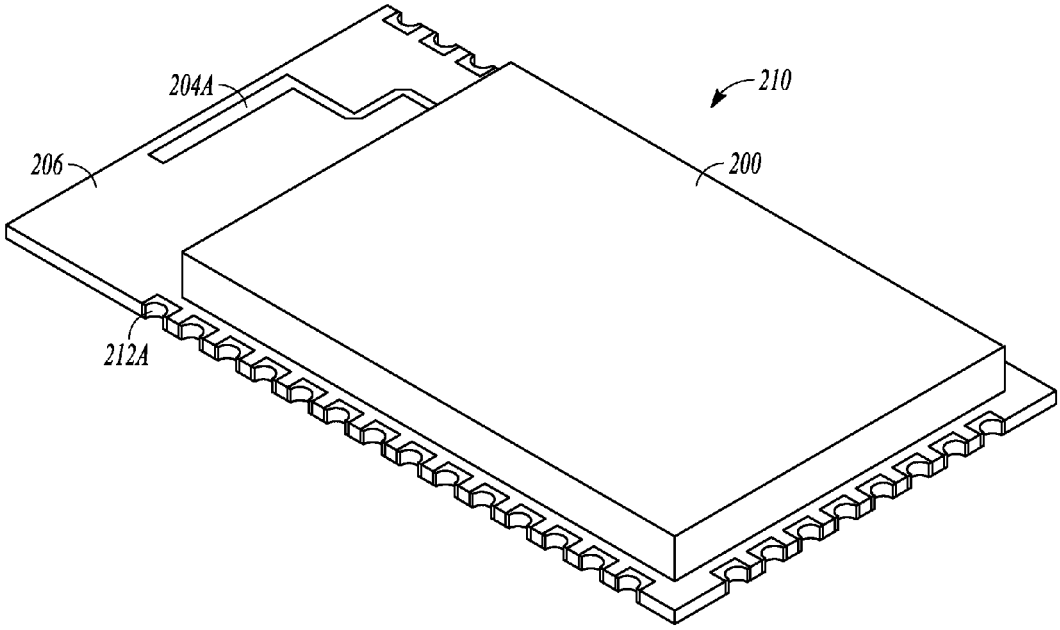
FIG. 2 illustrates generally an example of an apparatus comprising a surface mount assembly that can include an antenna structure and circuitry.

FIG. 2 illustrates generally an example of an apparatus comprising a surface mount assembly 210 that can include an antenna structure, such as including a first conductive portion 204A. In FIG. 2, a wireless communication circuit 200 can be included on a commonly shared dielectric substrate, such as comprising a dielectric sheet 206. One or more surface mount interconnects, such as a first interconnect 212A can be included underneath or around the perimeter of the assembly 210, such as to allow the assembly 210 to be solder attached or otherwise conductively coupled to another assembly, such as another printed circuit board assembly (e.g., a carrier board). In the example of FIG. 2, the first conductive portion 204A of the antenna structure can be located on a surface metal layer on the dielectric sheet 206 of the surface mount assembly 210, such as covered with solder mask, a conformal coating, or another material, or exposed (e.g., passivated). In an example, the assembly 210 can be configured for reflow solder attachment to another assembly, such as including materials having a specified thermal tolerance to allow for infrared or hot-air reflow without degradation of the dielectric sheet 206, detachment of the shield comprising the circuit 200, or damage to component included as a portion of the circuit 200.

Figure 3:
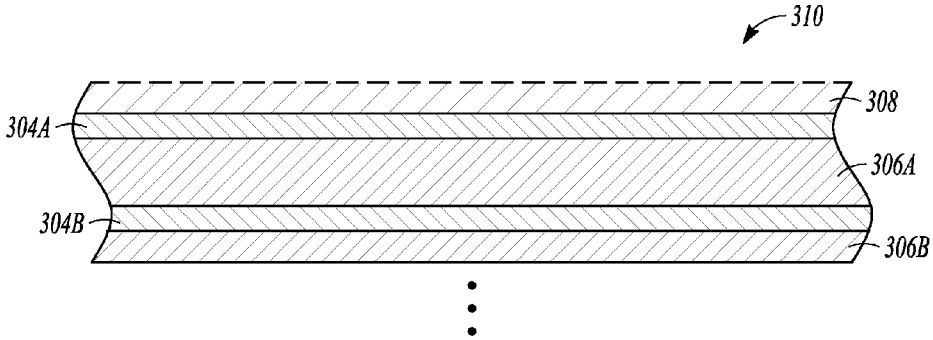
FIG. 3 illustrates generally an example of a section view of circuit assembly, such as a printed circuit board stackup comprising two or more dielectric layers.

FIG. 3 illustrates generally an example of a section view of circuit assembly 310, such as a printed circuit board stackup comprising two or more dielectric layers. In the example of FIG. 3, the assembly 310 can include a first conductive layer 304A, a first dielectric layer 306A comprising a dielectric material, a second conductive layer 304B, and a second dielectric layer comprising 306B comprising a dielectric material. In an example, one or more of the examples of FIG. 1, 3, or 4A-B can include an assembly 310 such as shown in FIG. 3. For example, one or more of the first or second dielectric layers 306A-B can include a rigid or flexible printed circuit board substrate material. Such materials can include a glass-epoxy laminate such as FR-4 or FR-406, or one or more other materials such as bismaleimide triazine (BT), such as including a glass transition temperature specified to avoid degradation of the dielectric material during one or more solder reflow operations or other thermal excursions. In an example, one or more of the first or second dielectric layers 306A-B can include a flexible dielectric material, such as a polyimide film.

The first or second conductive layers 304A-B can include a metal foil, such as adhered or attached to one or more of the dielectric layers 306A-B. Such a metal foil can include copper, aluminum, tungsten, platinum, gold, nickel, or one or more other conductive materials, such as in a foil or film configuration. Such a metal layer can be patterned or etched, such as using a lithographic processing technique, such as to provide electrical interconnections between circuitry included as a portion of the assembly 310. In an example, one or more portions of the antenna structure of FIG. 1, 3, or 4A-B can be formed on conductive layers 304A-B (e.g., a first conductive portion of the antenna can be formed on the first conductive layer 304A, and a second conductive portion of the antenna can be formed on the second conductive layer 304B, such as to "bury" the second conductive portion between the dielectric layers 306A-B). In an example, the first conductive layer 304A can be covered by a solder mask material layer 308. If present, such a solder mask material layer 308 is generally much thinner than the substrate thickness corresponding to the first or second dielectric layers 306A-B.

Figure 4A:
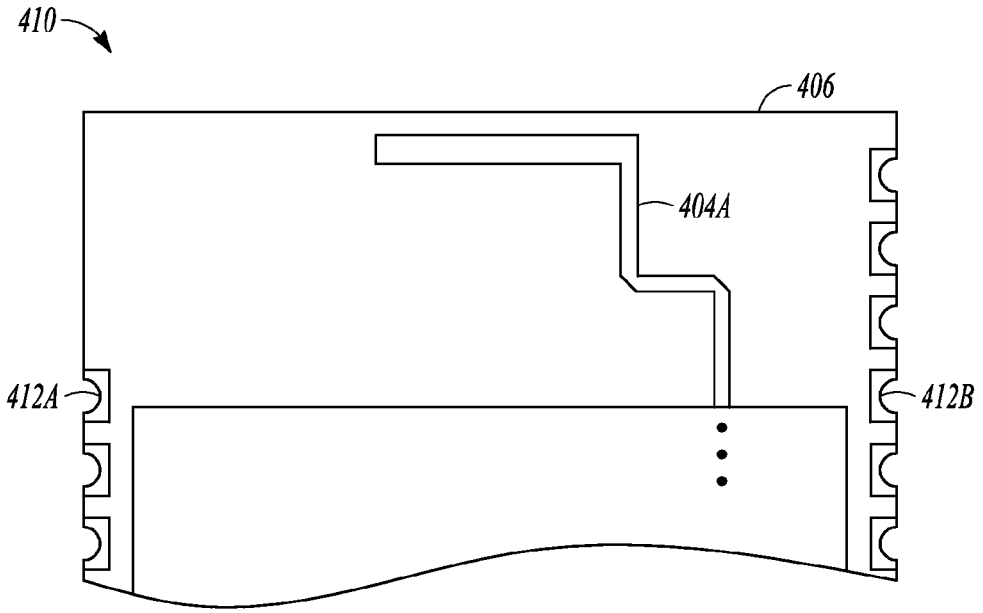
FIGS. 4A-B illustrate generally an example of a conductive pattern, such as forming a portion of an antenna structure.
Figure 4B:
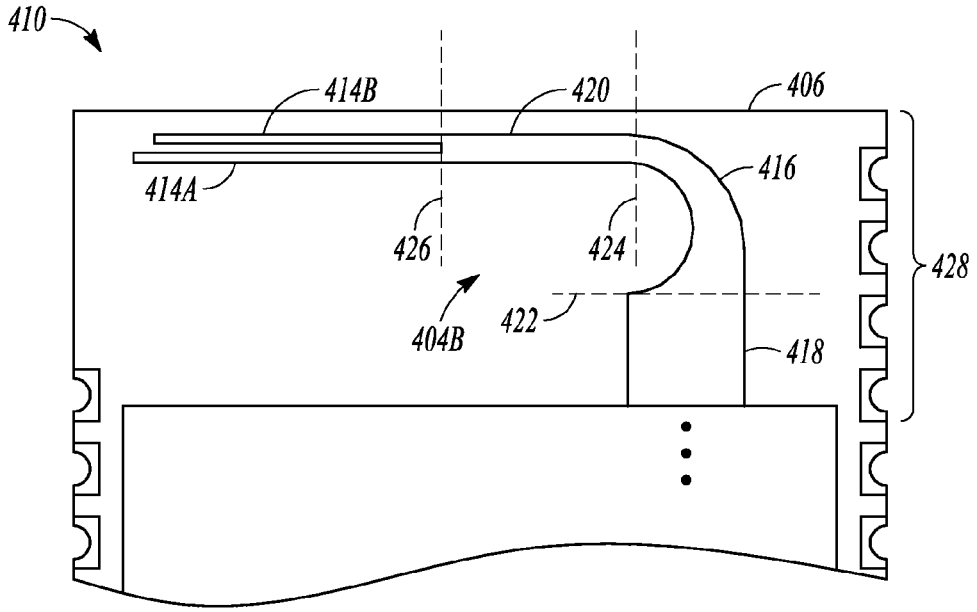

FIGS. 4A-B illustrate generally an example 410 of a conductive pattern (e.g., a metallization pattern), such as forming a portion of an antenna structure. In FIG. 4A, the antenna structure can include a first conductive portion 404A, located on an exterior surface of a dielectric sheet 406. The first conductive portion 404A can be coupled to an antenna feed included as a portion of a wireless communication circuit (e.g., a single-ended antenna input or output node). In an example, the first conductive portion can be located on a conductive layer attached to the dielectric sheet 406, the conductive layer including other circuitry or electrical interconnections, such as a first interconnect 412A or a second interconnect 412B. The first or second interconnects 412A-B can be used such as to mechanically attach or electrically couple an assembly such as including the example 410 to another assembly. For example, the example 410 can be a portion of a surface mount attachable module including an embedded antenna structure. In FIG. 4B, the antenna structure includes a second conductive portion 404B located within the dielectric sheet 406, such as laminated or otherwise formed within the sheet 406. In an example, such as shown in FIG. 3, the dielectric sheet 406 can include two or more dielectric material layers, and the second conductive portion 404B can be located between two dielectric layers. Similar to the example of FIG. 4A, the second conductive portion 404B can be formed on a conductive layer (e.g., a metallization layer) including other electrical interconnections. The second conductive portion 404B can be coupled to a return node (e.g., a "ground" or reference connection) of the wireless communication circuit. The second conductive portion 404B can include various regions, such as located adjacent to one or more regions of the first conductive portion 404A. For example, in a region near the wireless communication circuitry, the second conductive portion 404B can include a plane area 418. Such a plane area can be located adjacent to the first conductive portion 404A, such as to provide a transmission line configuration in the region near the wireless communication circuit. The plane area 418 can be separated from the first conductive portion 404A by a portion of the dielectric sheet 406, such as a layer of dielectric substrate material included in a laminated printed circuit board stackup as shown in FIG. 3.

In order to avoid reflections or to efficiently transfer power from the wireless communication circuit to the antenna structure, a conjugate impedance match is desired at the feed and return portions of the wireless communication circuit (e.g., at the antenna "port" of the communication circuit). The second conductive portion 404B can include a transition portion. Such a transition portion can encourage radiation, but without presenting an undesired impedance discontinuity. Such a discontinuity can cause unwanted reflections, or can decrease the usable bandwidth of the antenna structure. A curved transition portion 416 can provide both a tapered lateral width, along with a bend in the path of the second conductive portion 404B. Such a bend, transitioning from a first cross-sectional axis 422 to an orthogonal second cross-sectional axis 424, provides an antenna structure that efficiently uses the available surface area of the dielectric sheet 406. Such a bend can also enhance polarization diversity or can provide a more omnidirectional radiation pattern, such as shown in the radiation pattern of FIG. 7.

The second conductive portion 404B can include a distal portion, such as including a capacitive coupling portion 420 (e.g., between the second axis 424 and a third axis 426), and two or more parallel conductive strips such as a first strip 414A and a second strip 414B. The capacitive coupling portion 420 can be located adjacent to a similarly-shaped region along the first conductive portion 404A, such as separated by a portion of the dielectric sheet 406. The capacitive coupling portion 420 can be used to provide a tunable capacitive contribution to the input impedance of the antenna structure, or to adjust an electrical length of the antenna structure. The usable bandwidth of the antenna structure can be adjusted, such as via one or more of the first or second strips 414A-B. For example, the first or second strips 414A-B can be used to provide respective antenna resonant frequencies, such as controlled at least in part by a longitudinal length of the first or second strips 414A-B along the second conductive portion 404B. A variation in the length of first strip 414A as compared to the second strip 414B can be used to provide a broad range of usable frequencies, such as shown in the return loss simulated in the illustrative example of FIG. 5. Such a range can be provided by two resonant modes that are offset from each other slightly in frequency.

The present inventor has also realized that both the first conductive portion of FIG. 4A and the second conductive portion of FIG. 4B can provide radiation contributions in the far field. Also, providing a second conductive portion 404B located within the dielectric sheet 406 can reduce a sensitivity of the antenna structure to the surrounding mechanical environment (e.g., reducing a sensitivity of the antenna to conductive or dielectric loading by nearby structures such as in the near field). For example, an effective dielectric constant provided for the antenna (e.g., a dielectric constant including contributions from different dielectric materials surrounding various portions of the antenna) can be dominated by the dielectric constant of the dielectric sheet 406 rather than other surroundings.

In an example, a surface mount assembly such as shown in the example of FIG. 2 can include the first and second conductive portions of the FIGS. 4A-B. The surface mount assembly can be attached to another assembly, such as a printed circuit board (e.g., the surface mount assembly can be attached to "carrier" board). Generally, dielectric material or other non-conductive materials can be located near the surface mount assembly. Generally, ground or other planar conductors can be pulled back or omitted in the region 428, to avoid truncation of the radiation pattern. In an example, the region 428 of the surface mount assembly can extend outward from beyond a board outline or boundary of dielectric material or metal on an adjacent board to which the surface mount assembly is attached.

Figure 5:
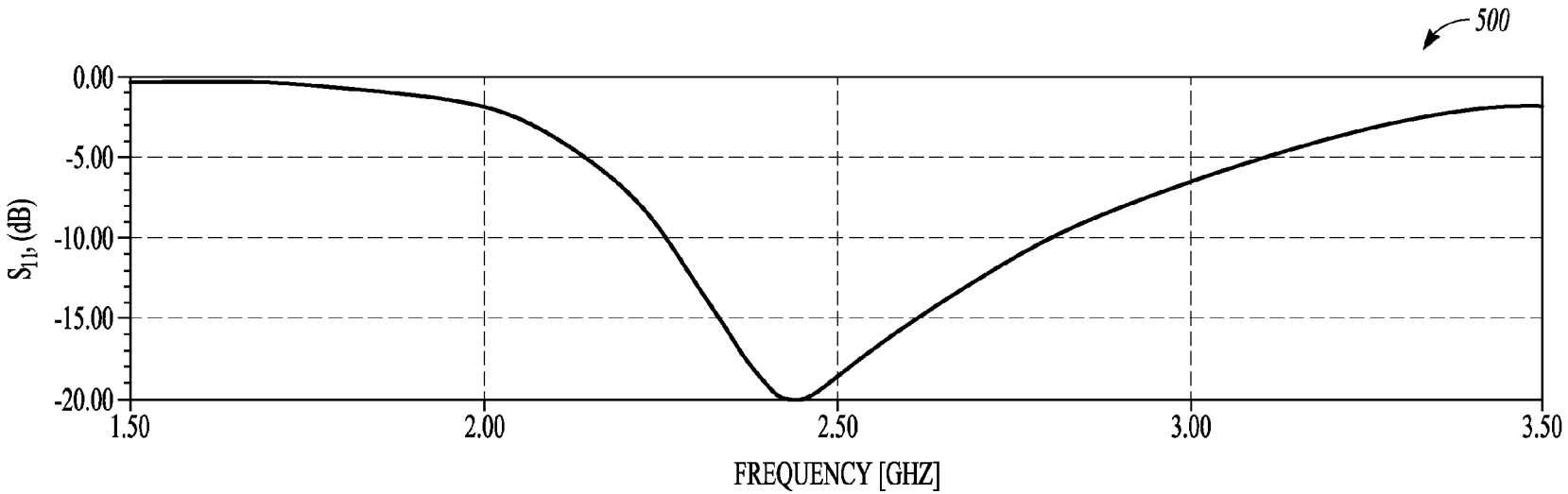
FIG. 5 illustrates generally an illustrative example of a return loss simulated for the antenna structure of FIG. 1-3, or 4A-B.

FIG. 5 illustrates generally an illustrative example 500 of a return loss (e.g., an $S_{11}$ parameter) simulated for the antenna structure of FIG. 1-3, or 4A-B. In this illustrative example, a usable range of frequencies can include a range from less than 2.3 GHz (e.g., 2300 MHz) to more than 2.8 GHz (e.g., 2800 MHz), such as corresponding to a specified $S_{ii}$ parameter of −10 dB or lower (e.g., a return loss of 10 dB, or a voltage standing wave ratio (VSWR) of 2:1 or less), or one or more other values.

Such a return loss provides a considerably wider range of usable operating frequencies than is generally needed for an IEEE 802.15.4 (2003) PHY layer (e.g., 16 channels times 5 MHz of bandwidth per channel, corresponding to 80 MHz of bandwidth, such as including a frequency range from about 2402.5 MHz to about 2477.5 MHz), where the antenna input impedance is within a specified range (e.g., corresponding to the return loss of −10 dB or lower (more negative)). In this manner, the present inventor has recognized that such an antenna structure can be cost effective (e.g., existing printed circuit board assembly materials can be used eliminating the incremental cost of the antenna). Such an antenna can also be relatively insensitive to production variations in conductor or dielectric geometry, temperature, moisture content, conductivity, or surrounding use environment. For example, the center frequency of around 2.45 GHz would need to shift by approximately plus 150 MHz or minus 300 MHz to result in a return loss of greater than −10 dB. Such a shift is unlikely to occur within the expected range of production variations and usage environments.

Figure 6:
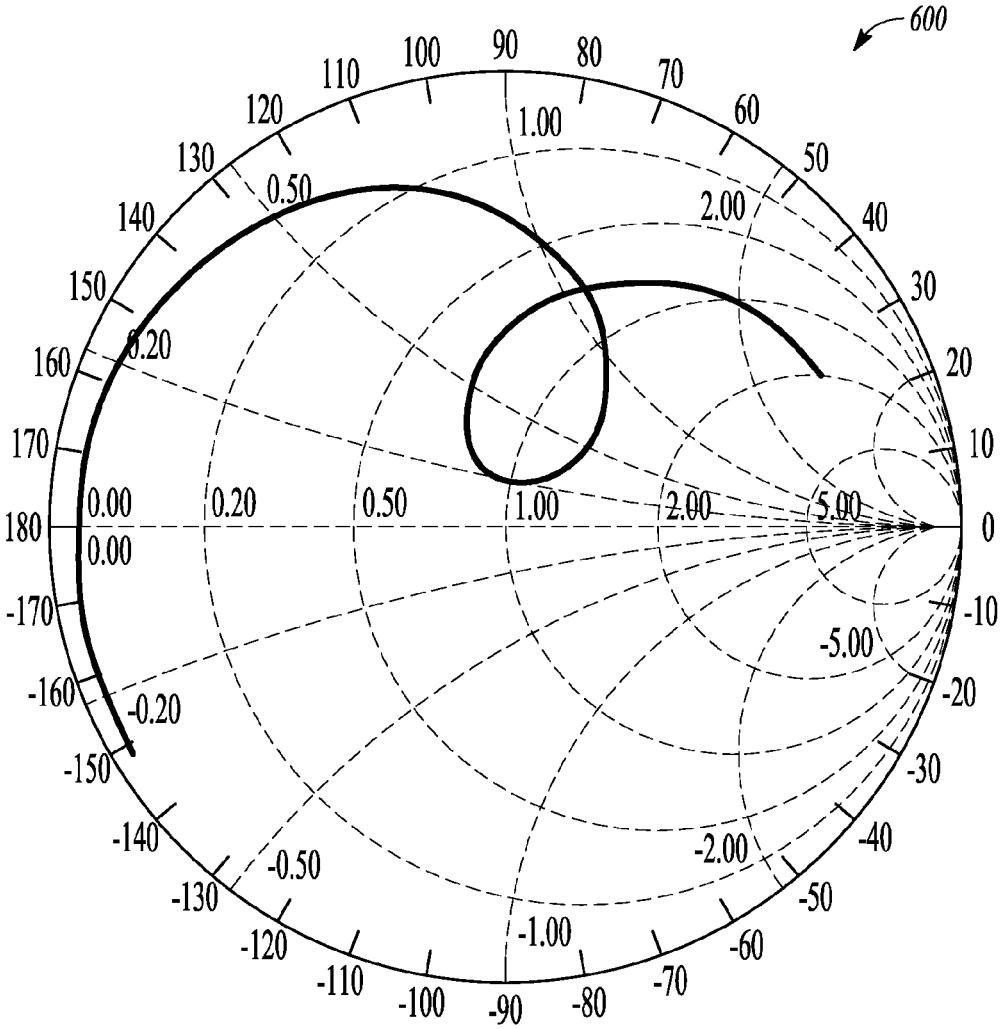
FIG. 6 illustrates generally an illustrative example of an impedance Smith Chart for the antenna structure of FIG. 1-3, or 4A-B.

FIG. 6 illustrates generally an illustrative example 500 of an impedance Smith Chart simulated for the antenna structure of FIG. 1-3, or 4A-B. In the example of FIG. 5, a loop in the impedance response can indicate a double-resonant antenna structure, such as corresponding to the relatively broad return loss shown in FIG. 5. As discussed above in the examples of FIGS. 4A-B, various antenna structure features can be used to tune the center frequency and bandwidth of such a double-resonant response (such as the relative lengths of the first and second strip 414A-B as shown in FIG. 4B).

Figure 7:
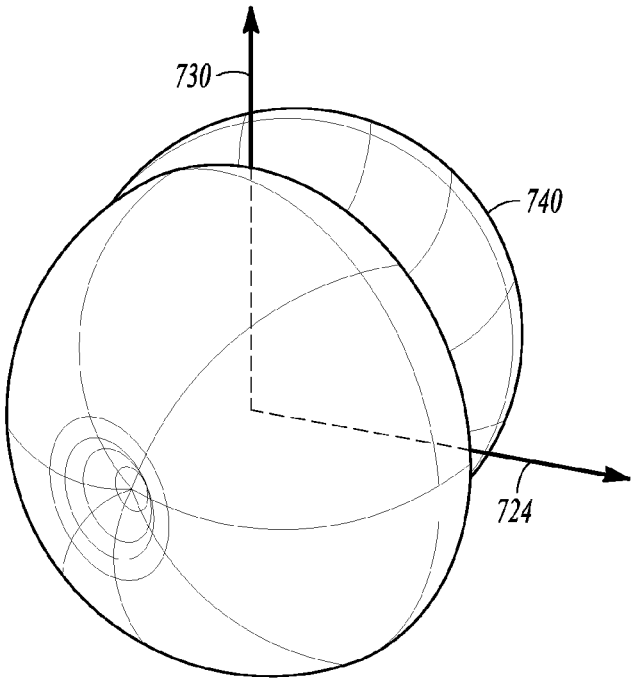
FIG. 7 illustrates generally an illustrative example of a three dimensional radiation pattern corresponding to the antenna structure of FIG. 1-3, or 4A-B.

FIG. 7 illustrates generally an illustrative example of a three dimensional radiation pattern 740 corresponding to the antenna structure of FIG. 1-3, or 4A-B. Such a radiation pattern can be plotted with respect to first axis 724 (such as corresponding to the axis 424 of FIG. 4B), and a second axis 730 (such as orthogonal to both the axes 422 and 424 of FIG. 4B). The antenna pattern includes a relatively omnidirectional pattern, including a peak gain of more than 2 dBi.

Figure 8:
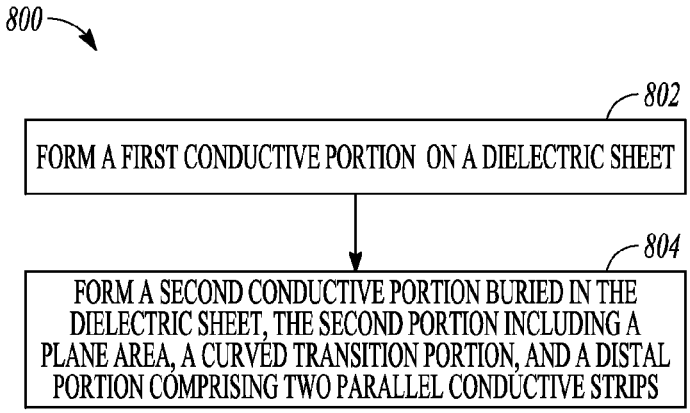
FIG. 8 illustrates generally a technique, such as a method, for forming an antenna structure.

FIG. 8 illustrates generally a technique, such as a method 800, for forming an antenna structure. At 802, the technique includes forming a first conductive portion of an antenna structure, such as shown and discussed above in the examples of FIGS. 2-3, and 4A-B, such as a conductive layer on a dielectric material. At 804, the technique includes forming a second portion of the antenna structure, such as shown and discussed above in the examples of FIGS. 2-3, and 4A-B, such as a second conductive portion buried in the dielectric sheet. The forming the second conductive portion includes forming a plane area adjacent to the first conductive portion, forming a curved transition portion, and forming a distal portion, such as discussed above in FIG. 4B.

Various Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(*b*), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An apparatus, comprising:

a dielectric sheet;

an antenna structure including:

a first conductive portion located on an exterior surface of the dielectric sheet and configured for coupling to an antenna feed for a wireless communication circuit; and a second conductive portion buried in the dielectric sheet and configured for coupling to a return portion of the wireless communication circuit, the second conductive portion including:

a plane area adjacent to the first conductive portion in a region proximal to the feed portion and separated from the first conductive portion by a portion of the dielectric sheet;

a curved transition portion, the transition portion including a lateral width that tapers along the length of the second conductive portion; and a distal portion comprising two parallel conductive strips, the distal portion electrically coupled to the plane area via the curved transition portion, wherein the parallel conductive strips are thinner in lateral width than the plane area.

2. The apparatus of claim 1, further comprising the wireless communication circuit, wherein the wireless communication circuit includes an antenna feed coupled to the first conductive portion and a return portion coupled to the plane area of the buried second conductive portion.

3. The apparatus of claim 1, wherein the dielectric sheet is selected from one or more of a flexible printed circuit board substrate material or a rigid printed circuit board substrate material.

4. The apparatus of claim 3, wherein the apparatus is configured for surface mount attachment to a second printed circuit board assembly.

5. The apparatus of claim 3, wherein the first conductive portion is covered with another dielectric sheet comprising a solder mask material or a conformal coating.

6. The apparatus of claim 3, wherein the dielectric sheet further includes a metal layer configured to provide electrical interconnections for circuitry, and wherein one or more of the first or second conductive portions comprises a portion of the metal layer.

7. The apparatus of claim 3, wherein the dielectric sheet comprises two or more layers of dielectric material; and wherein the buried second conductive portion is located on a metal layer between two of the dielectric layers of the dielectric sheet.

8. The apparatus of claim 7, wherein one of the two dielectric layers includes an electrical interconnect configured for attachment to a second printed circuit board assembly.

9. The apparatus of claim 8, wherein the antenna structure is configured for operation within a specified range of frequencies spanning at least 500 MHz when the printed circuit board assembly is attached to the second printed circuit board assembly.

10. The apparatus of claim 9, wherein the transition portion is configured to provide a specified input impedance range within the specified range of frequencies.

11. A printed circuit board assembly, comprising:

a dielectric sheet having two or more layers of dielectric material;

an antenna structure including:

a first conductive portion located on an exterior surface of the dielectric sheet and configured for coupling to an antenna feed for a wireless communication circuit; and a second conductive portion located on a metal layer between two of the dielectric layers of the dielectric sheet and configured for coupling to a return portion of the wireless communication circuit, the second conductive portion including:

a plane area adjacent to the second conductive portion in a region proximal to the feed portion and separated from the first conductive portion by a portion of the dielectric sheet;

a curved transition portion, the transition portion including a lateral width that tapers along the length of the second conductive portion; and a distal portion comprising two parallel conductive strips, the distal portion electrically coupled to the plane area via the curved transition portion, wherein the parallel conductive strips are thinner in lateral width than the plane area; and a wireless communication circuit, wherein the wireless communication circuit includes an antenna feed coupled to the first conductive portion and a return portion coupled to the plane area of the second conductive portion.

12. A method, comprising:

forming an antenna structure including:

forming a first conductive portion located on an exterior surface of the dielectric sheet and configured for coupling to an antenna feed for a wireless communication circuit; and forming a second conductive portion buried in a dielectric sheet and configured for coupling to a return portion of the wireless communication circuit, the second conductive portion including:

a plane area adjacent to the first conductive portion in a region proximal to the feed portion and separated from the first conductive portion by a portion of the dielectric sheet;

a curved transition portion, the transition portion including a lateral width that tapers along the length of the buried second conductive portion; and a distal portion comprising two parallel conductive strips, the distal portion electrically coupled to the plane area via the curved transition portion, wherein the parallel conductive strips are thinner in lateral width than the plane area.

13. The method of claim 12, wherein the dielectric sheet is selected from one or more of a flexible printed circuit board substrate material or a rigid printed circuit board substrate material.

14. The method of claim 13, comprising attaching the antenna structure to a second printed circuit board assembly via a surface mount attachment technique.

15. The method of claim 13, comprising covering the first conductive portion with another dielectric sheet comprising a solder mask material or a conformal coating.

16. The method of claim 13, comprising forming the dielectric sheet including a metal layer configured to provide electrical interconnections for circuitry, and wherein one or more of the first or second conductive portions comprises a portion of the metal layer.

17. The method of claim 16, wherein the dielectric sheet comprises two or more layers of dielectric material; and wherein the buried second conductive portion is located on a metal layer between the two dielectric layers.

18. The method of claim 17, comprising forming, on one of the two dielectric layers, an electrical interconnect configured for attachment to a second printed circuit board assembly.

19. The method of claim 18, comprising wirelessly transferring information electromagnetically using the antenna structure within a specified range of frequencies.

20. The method of claim 19, wherein the specified range of frequencies spans at least 500 MHz when the printed circuit board assembly is attached to the second printed circuit board assembly.

* * * * *